US005295854A

United States Patent [19]

Olson

[11] Patent Number: 5,295,854

[45] Date of Patent: Mar. 22, 1994

[54] PASSIVE CONNECTOR LATCH WITH CAMMING ACTION

[75] Inventor: Stanley W. Olson, East Berlin, Pa.

[73] Assignee: E. I. Du Pont de Nemours and Company, Wilmington, Del.

[21] Appl. No.: 964,086

[22] Filed: Oct. 21, 1992

[51] Int. Cl.[5] ..... H01R 13/627

[52] U.S. Cl. ..... 439/350; 439/357

[58] Field of Search ..... 439/345, 350, 351, 352, 439/353, 354, 357; 285/305, 81, 921; 403/405.1, 409.1

[56] References Cited

U.S. PATENT DOCUMENTS

| | | | |
|---|---|---|---|
| 4,273,403 | 6/1981 | Cairns | 439/345 |
| 4,787,860 | 11/1988 | Bender | 439/358 |
| 4,900,263 | 2/1990 | Manassero et al. | 439/358 |
| 4,925,398 | 5/1990 | Samejima et al. | 439/357 |
| 4,938,710 | 7/1990 | Aihara et al. | 439/345 |
| 4,979,910 | 12/1990 | Revil et al. | 439/357 |

*Primary Examiner*—Neil Abrams
*Assistant Examiner*—Khiem Nguyen
*Attorney, Agent, or Firm*—Woodcock Washburn Kurtz Mackiewicz & Norris

[57] ABSTRACT

A passive latch system for matable connector housings, one of which has at least one working surface depressed and sloping from a reference surface thereof to form part of a latching aperture and the other of which has at least one working surface raised and sloping from a reference surface thereof to form part of a latching projection, is characterized in that the sloped working surface also is tapered, and, optionally, inclined.

6 Claims, 12 Drawing Sheets

PASSIVE CONNECTOR LATCH WITH CAMMING ACTION

BACKGROUND OF THE INVENTION

1. Field of the Invention

The present invention relates to a passive latching system for connector housings.

2. Description of the Prior Art

As connectors get smaller the force required to withdraw a terminal mounted in a first connector housing from a mated terminal mounted in another connector housing is reduced. Concomittant with this reduction in the withdrawal force is the need to provide a supplementary holding force that assists in retaining the housings together. Passive latch systems have been useful for this purpose in situations, as in small connectors, where space availability is at a premium.

U.S. Pat. Nos. 4,787,860 (Bender); 4,900,263 (Manessero et al.); 4,925,398 (Samejima et al.); and 4,938,710 (Aihara et al.) each exemplify a passive latching system for connecting a pair of connectors. Shown in FIG. 1 is a schematic illustration of the basic functional elements of a passive latching system useful to interconnect a first connector housing $H_1$ with a second connector housing $H_2$. The housings $H_1$ and $H_2$, which generally represent any two connector housings, are inserted into mated relationship in the direction of the arrow M (latching direction) and withdrawn from the mated relationship in the direction of the arrow W (unlatching direction).

The passive latching system includes a projection P mounted on the housing $H_1$. The projection P is received in a complementary aperture A formed in the housing $H_2$. The projection P is defined above a reference surface $R_1$ on the housing $H_1$ by raised working surfaces $S_{p1}$, $S_{p2}$. The surface $S_{p1}$ forms a sloped lead-in ramp while the surface $S_{p2}$ defines a sloped exit ramp. The slopes are taken in the x-z plane and are defined with respect to the reference surface $R_1$. These slopes are indicated by the respective characters $m_{in}$, $m_e$. The slopes need not necesarily be equal. The projection P may take any of a variety of forms and may include the flat surface $S_{p3}$, if desired. The edge between the working surface $S_{p2}$ and the reference surface $R_1$ is indicated by the character $E_p$. The free edge of the surface $S_{p2}$ lies a distance h above the surface $R_1$.

In complementary fashion the aperture A is defined by a depression extending below a reference surface $R_2$ formed on the housing $H_2$. (In FIG. 1 the reference surface $R_1$ is defined on what appears as the "top" of the member indicated as $H_1$ while the reference surface $R_2$ is defined on what appears as the "bottom" of the member indicated as $H_2$. The relative position of the members $H_1$, $H_2$ may be inverted, if desired.) The aperture A is defined by a plurality of surfaces, at least one of which defines a working surface $S_a$. The aperture of which the surface $S_a$ forms a part may take a variety of forms, including an enclosed recess as illustrated in FIGS. 1, 2B through 2G, 3D through 3I, 4A and 4B, or a partially enclosed slot, as illustrated in FIGS. 4C and 4D. The edge between the working surface $S_a$ and the reference surface $R_2$ is indicated by the character $E_a$. It is noted that the edges $E_p$ and $E_a$ extend perpendicular to the latching direction M (and to the unlatching direction W).

As the housing $H_1$ is advanced into the housing $H_2$ (in the direction of the arrow M) the lead-in ramp formed by the working surface $S_{p1}$ on the housing $H_1$ lifts the reference surface $R_2$ on the housing $H_2$. The housing $H_1$ is advanced until the projection P enters into aperture A. The working surface $S_a$ then snaps behind the raised working surface $S_{p2}$ thus latching the housing $H_1$ to the housing $H_2$. An audible clicking sound usually accompanies the latching of the housings.

When the parts are to be separated the process is reversed. The housings $H_1$ and $H_2$ are relatively moved in the direction of the withdrawal arrow W (unlatching direction). In this instance the portion of the raised working surface $S_{p2}$ along the edge $E_p$ thereof engages along a line of contact with the edge $E_a$ of the aperture A in the housing $H_2$. The line of contact between the working surface $S_{p2}$ and the edge $E_a$ exists over a length portion D (shown as measured along the reference surface $R_1$) during the withdrawal of the housings. Thus, a relatively substantial force acting in the direction of the arrow W may be required to lift the reference surface $R_2$ as the housings are withdrawn from each other.

In view of the foregoing it is believed advantageous to provide a passive latching system that requires a reduced withdrawal force to separate the mated housings.

SUMMARY OF THE INVENTION

The present invention relates to a passive latch for interconnecting a first and a second connector housing when the same are relatively moved in a latching direction with respect to each other. Each of the housings has a reference surface thereon, one of the housings having at least one working surface depressed from the reference surface thereon to form part of a latching aperture while the other of the housing has at least one working surface raised from the reference surface thereon to form part of a latching projection. The working surface on one of the housings is sloped with respect to its reference surface. Either the working surface defining part of the latching aperture or the working surface defining the exit ramp surface of the latching projection may be the sloped surface.

In accordance with one aspect of the present invention the sloped working surface also is tapered in a direction that is generally parallel with respect to the latching direction.

Further, in accordance with another aspect of the invention, the tapered working surface is also inclined in a direction that is substantially perpendicular to the latching direction.

BRIEF DESCRIPTION OF THE DRAWINGS

The invention will be more fully understood from the following detailed description, taken in accordance with the accompanying drawings, which form a part of this application and in which:

FIG. 2A is a perspective view of a latching projection of a passive latch system in accordance with one embodiment of the present invention, while

FIGS. 3A, 3B and 3C are respective perspective, plan, and elevation views of a latching projection in accordance with a modified embodiment of the present invention while

FIGS. 4A through 4H, in general, illustrate a particularized implementation of the latching system of the present invention in which FIGS. 4A and 4B are, respectively, plan and side section views of a housing having a pair of latching apertures formed therein;

FIGS. 4C and 4D are, respectively, plan and side section views of a housing similar to that shown in FIGS. 4A, 4B in which the apertures in the housing communicate with a slot;

FIGS. 4E and 4F are plan and side section views of a mating housing having a pair of latching projections thereon;

FIG. 4G illustrates the reaction of the housing of FIGS. 4A, 4B during the unlatching therefrom of the housing in FIGS. 4E and 4F; and FIG. 4H illustrates the reaction of the housing of FIGS. 4C, 4D during the unlatching therefrom of the housing in FIGS. 4E and 4F.

DETAILED DESCRIPTION OF THE INVENTION

Figure 1:
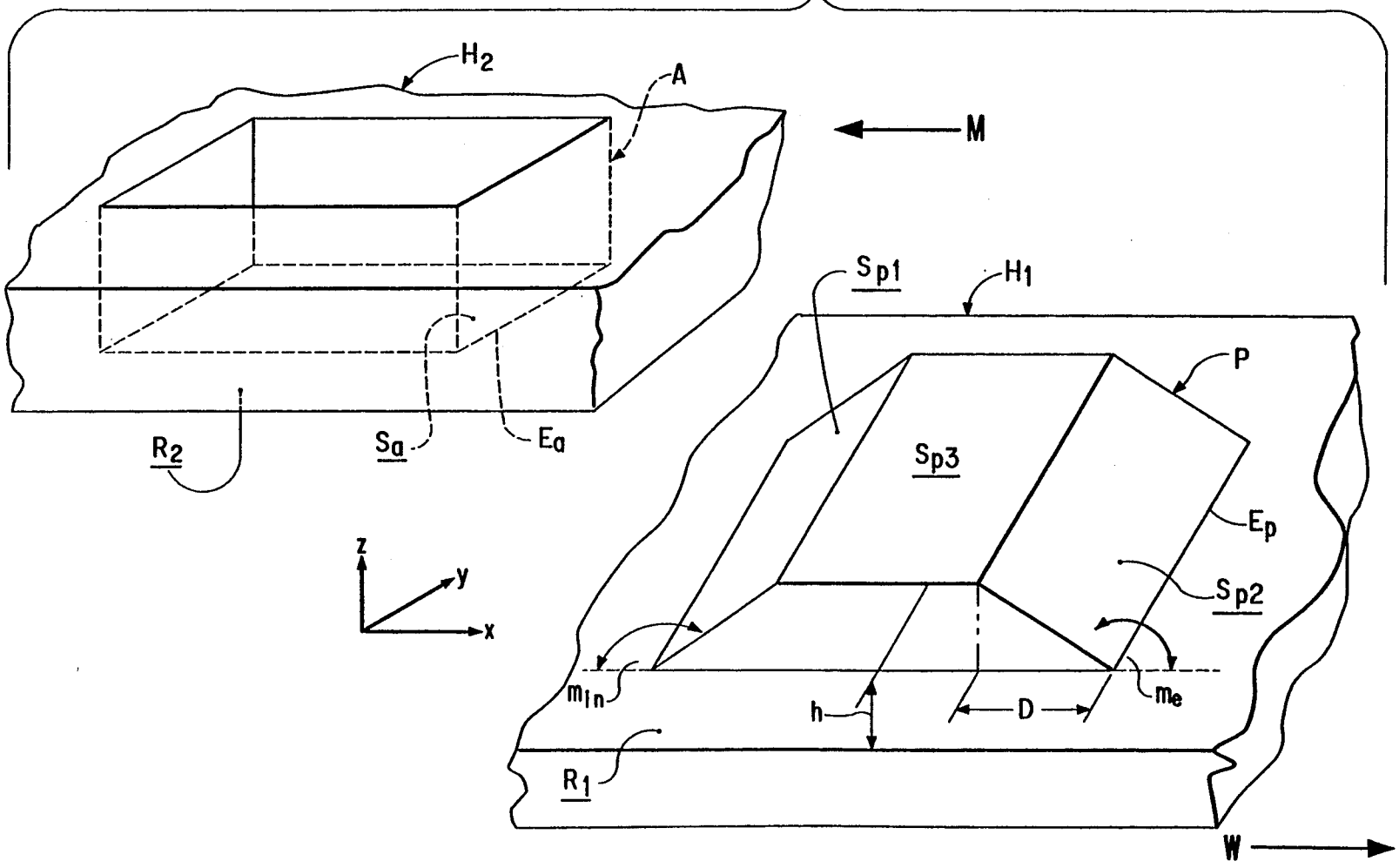
FIG. 1 (PRIOR ART)
FIG. 1 is a perspective view of a typical prior art passive latch system.

Throughout this application similar reference numerals refer to similar elements in all Figures of the drawings.

Figure 2A:
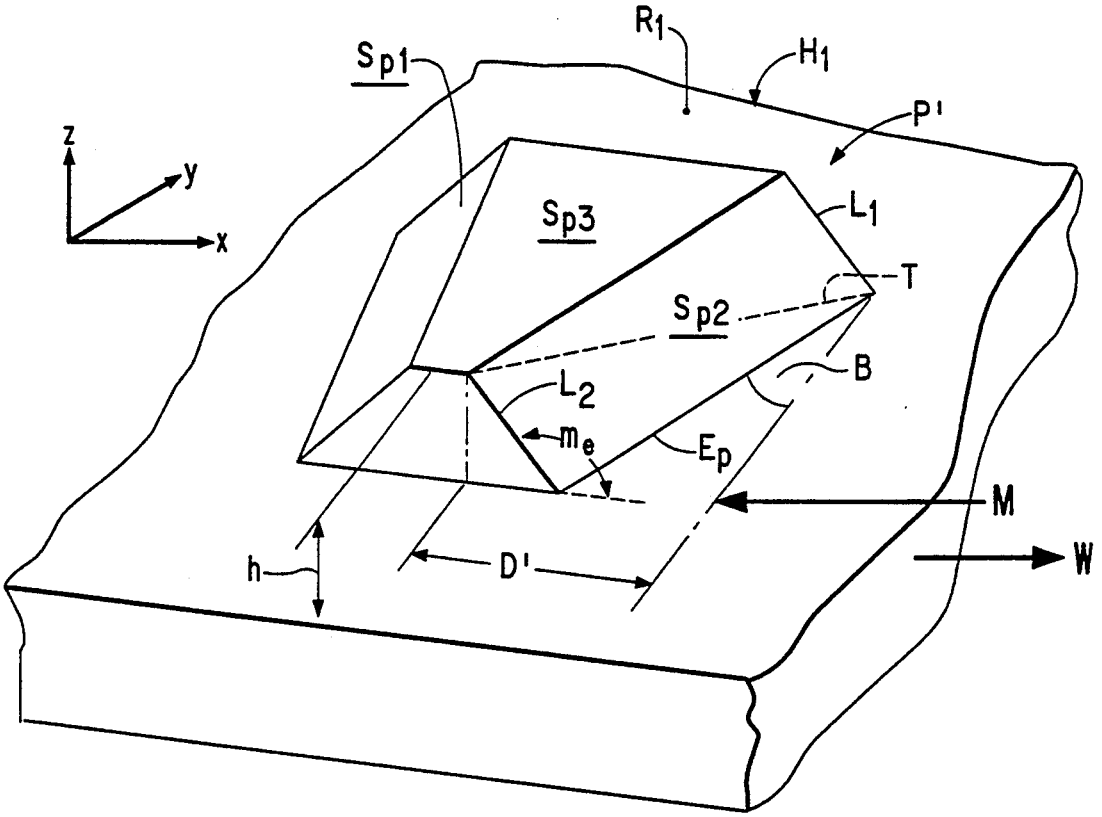
Figure 2B:
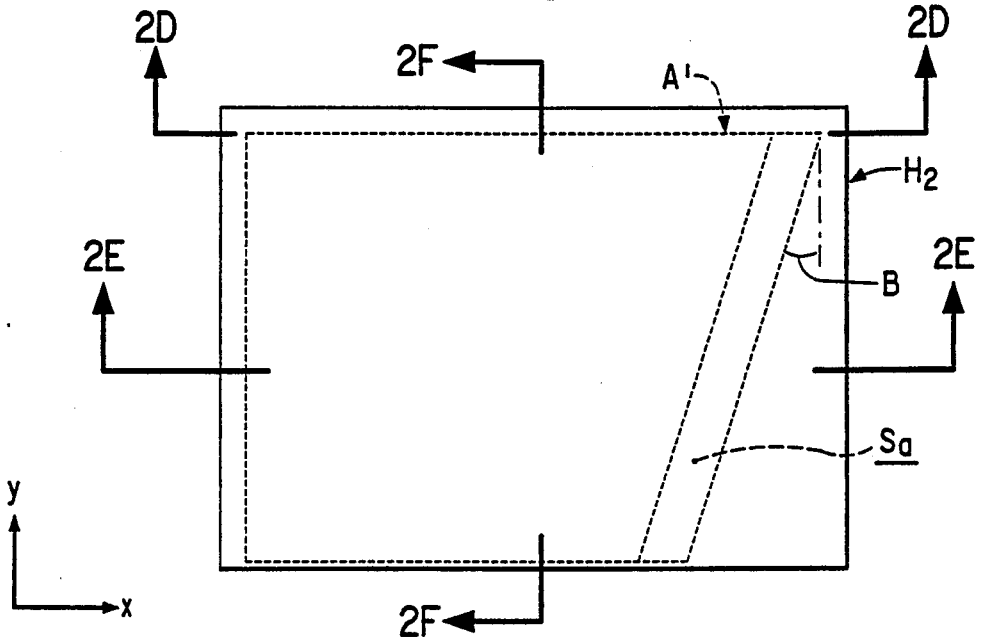
FIGS. 2B through 2F are various views of a latching aperture of a passive latch system also in accordance with this embodiment of the present invention, and in particular, with FIG. 2B being a plan view of a housing having a latching aperture therein, FIG. 2C being a perspective view of a housing having a latching aperture therein, and FIGS. 2D, 2E and 2F being sectional views taken along respective section lines 2D–2D, 2E–2E, 2F–2F, each section being respectively shown in FIG. 2B and in FIG. 2C.
Figure 2C:
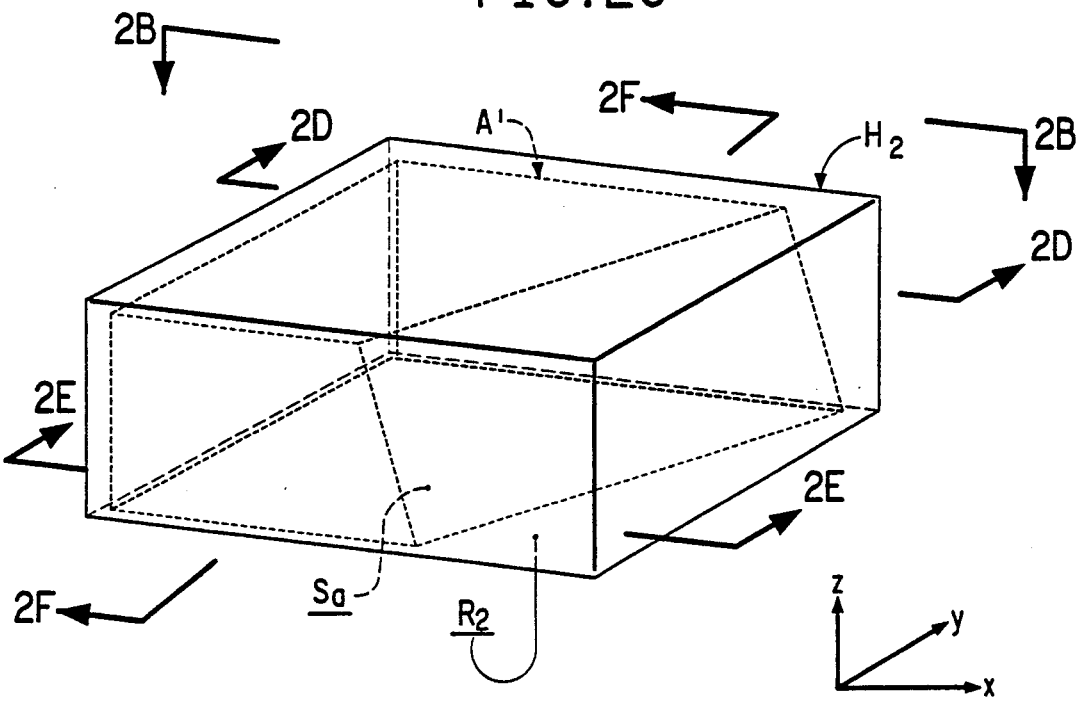
Figure 2D:
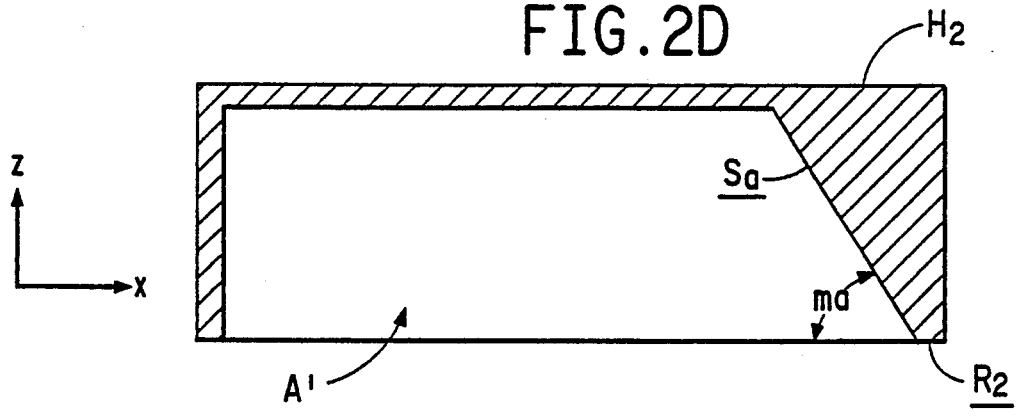
Figure 2E:
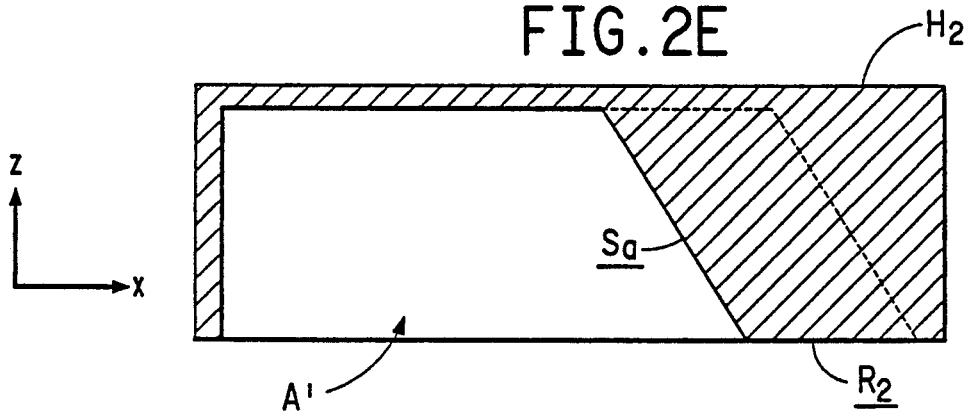
Figure 2F:
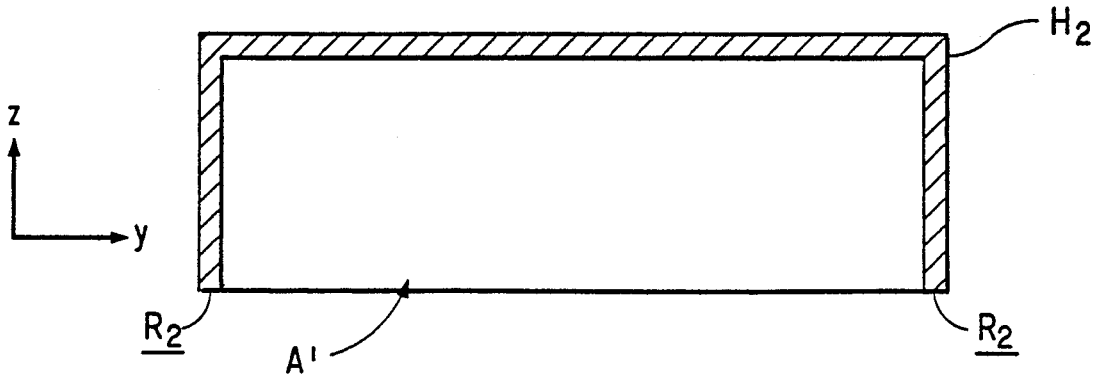
Figure 3A:
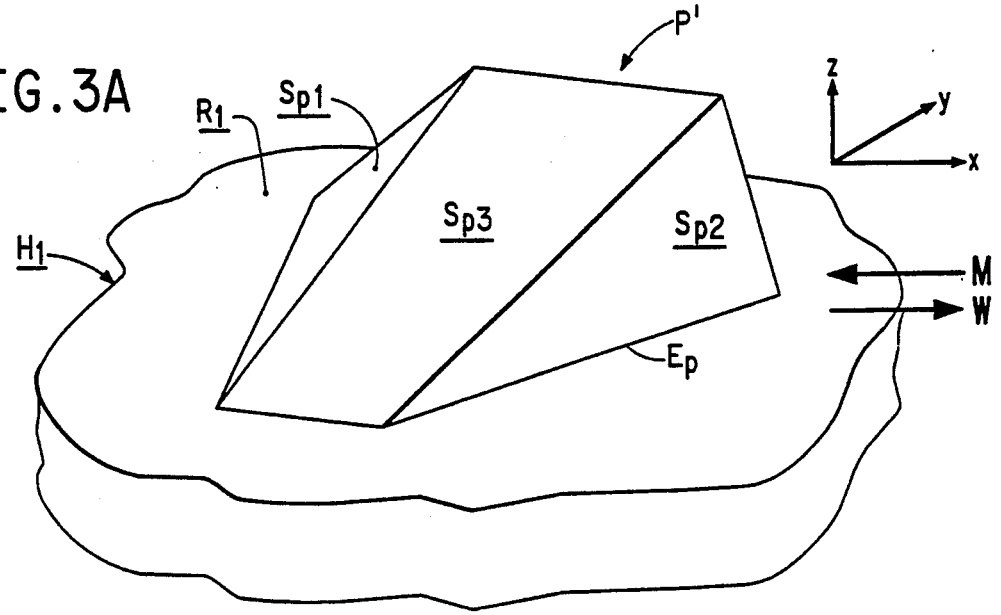
Figure 3B:
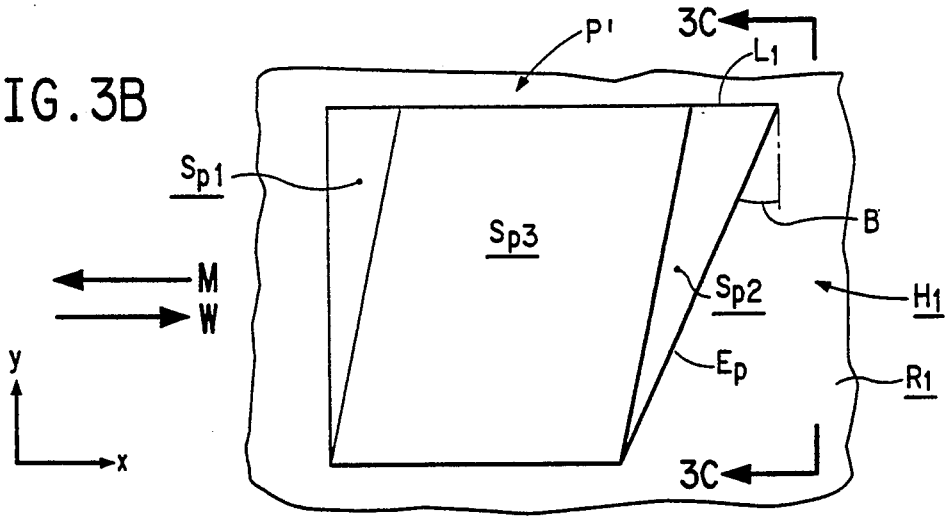
Figure 3C:
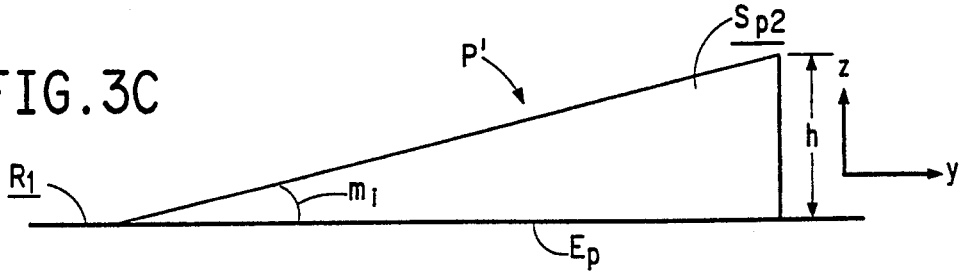
Figure 3D:
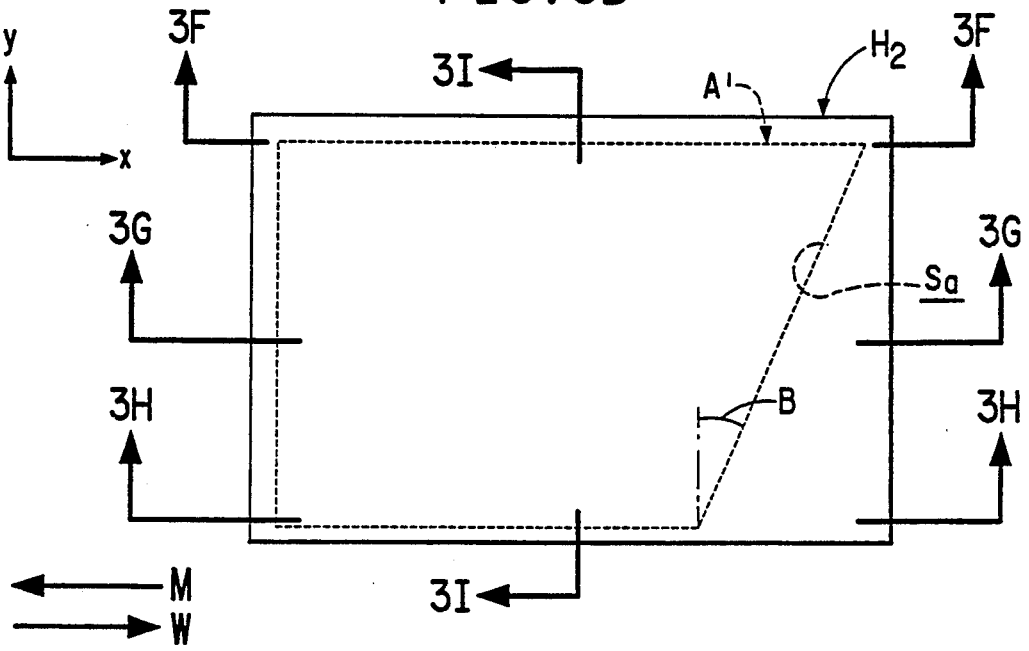
FIGS. 3D through 3I present various views of a latching aperture of a passive latch system in accordance with this modified embodiment of the present invention, and in particular, with FIG. 3D being a plan view of a housing having a latching aperture therein, FIG. 3E being a perspective view of a housing having a latching aperture therein, and FIGS. 3F, 3G, 3H and 3I being sectional views taken along respective section lines 3F-3F, 3G-3G, 3H-3H, and 3I-3I, each section being respectively shown in FIGS. 3D and 3E.
Figure 3E:
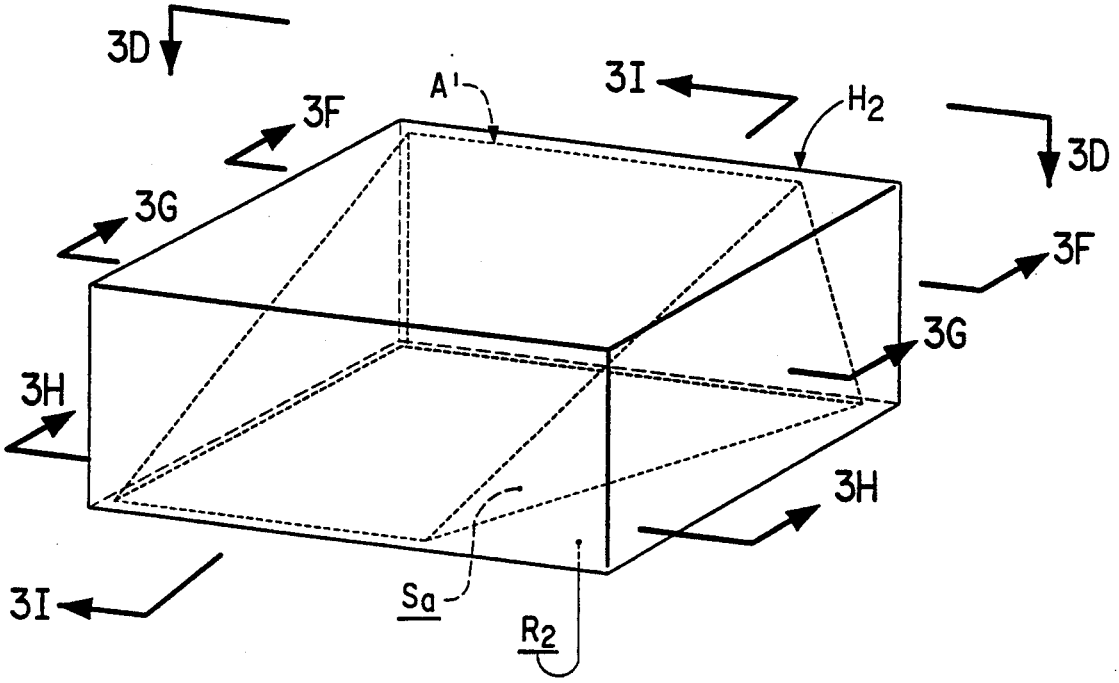
Figure 3F:
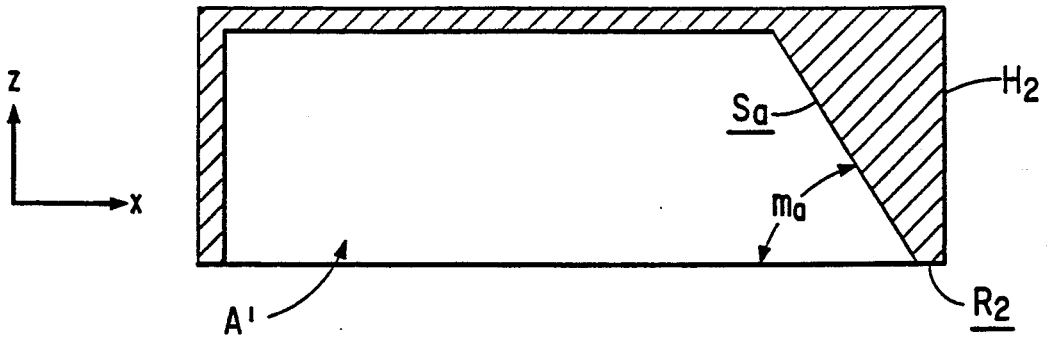
Figure 3G:
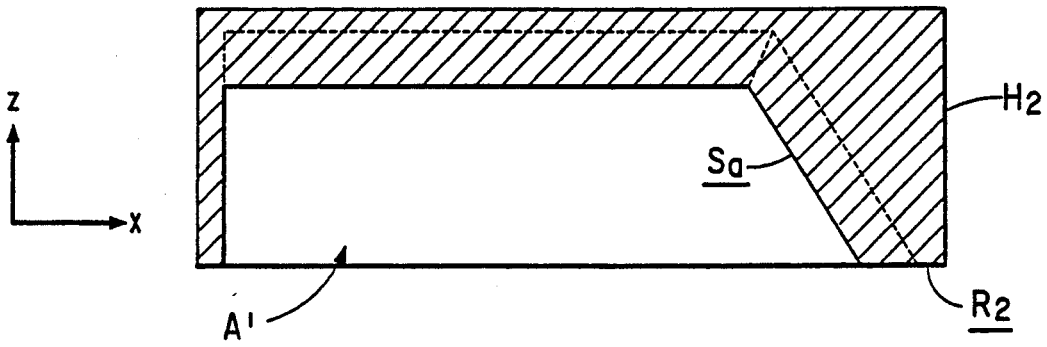
Figure 3H:
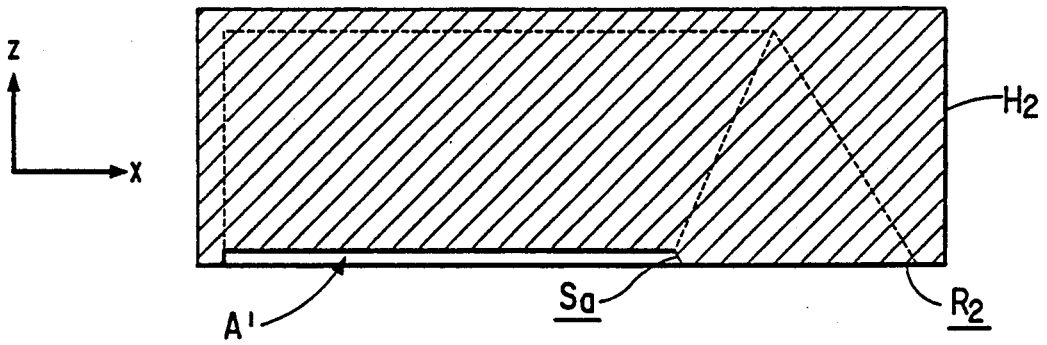
Figure 3I:
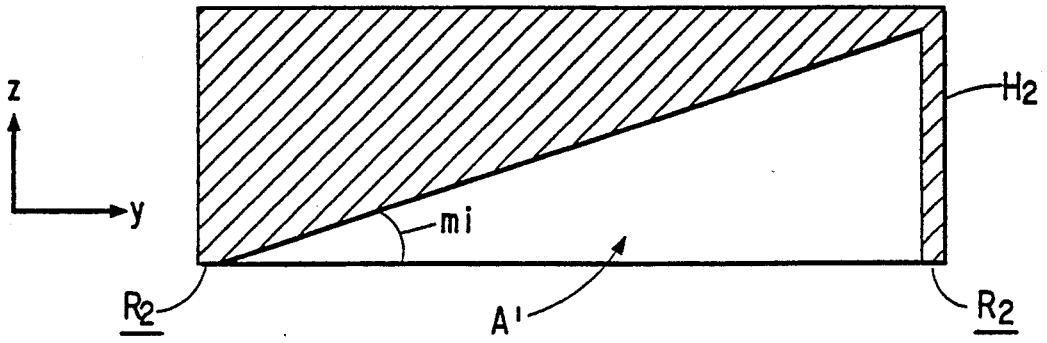

With reference to FIG. 2A shown is a latching projection P' in accordance with this invention. The latching projection P' is formed on the housing $H_1$ that is to be mated with a housing $H_2$ having an aperture A therein as shown in FIG. 1. The latching projection P' is improved in that the working surface $S_{p2}$ defining the exit ramp is tapered in a direction that is generally parallel with respect to the latching direction M (and to the unlatching direction W). The free edge of the surface $S_{p2}$ is spaced the height h above the surface $R_1$. The working surface $S_{p2}$ is sloped in the x-z plane at the slope angle $m_e$ to the surface $R_1$. By "tapered" it is meant that the edge $E_p$ of the sloped working surface $S_{p2}$ does not lie on the reference surface $R_1$ in an orientation that is perpendicular to the latching (or unlatching) direction M (or W), but instead lies on the reference surface $R_1$ in an orientation defining a predetermined angle B (in the x-y plane) with respect to the latching (or unlatching) direction M (or W). The angle B may have any convenient value that is less than perpendicular (i.e., ninety degrees) to the latching direction M (and to an unlatching direction W).

Alternately stated, and speaking with reference to the unlatching direction W, tapering of the working surface $S_{p2}$ results in the lateral end $L_1$ of that working surface $S_{p2}$ being presented more forwardly than the lateral end $L_2$ thereof. Thus, owing to the tapering, as the housings are withdrawn only progressive point contact is established between a point on the working surface $S_{p2}$ and the edge $E_a$ of the working surface $S_a$ of the aperture A in the housing $H_2$. Point contact between the working surface $S_{p2}$ and the edge $E_a$ generates a prying, or camming, action to assist in lifting the reference surface $R_2$.

It should be appreciated that the other element of the passive latching system may be modified in keeping with the present invention. FIGS. 2B through 2F illustrate the manner in which the structure of the aperture A' may be modified for use with a complementary latching projection that is generally rectanguloid in shape. (Such a projection is not expressly shown, but would correspond to the shape of the material removed to define an aperture A as seen in FIG. 1).

As seen from FIGS. 2B through 2F the working surface $S_a$ of such a latching aperture A', that is, the surface depressed from the reference surface $R_2$ to form part of the aperture A', is both sloped in the x-z plane (e.g., FIG. 2D) at an angle $m_a$ that is the complement to the angle $m_e$ and tapered in the x-y plane (e.g., FIG. 2B) at an angle B. The same prying and camming action as earlier described in connection with FIG. 2A attends the relative movement (in the direction W) of housings having a passive latching system including such an aperture structure.

A further modification to the projection P' or the aperture A' (as respectively shown in FIG. 2A and FIGS. 2B through 2G) is respectively illustrated in FIGS. 3A through 3C and FIGS. 3D through 3I. In these Figures the tapered working surface $S_{p2}$ or $S_a$, as the case may be, is also inclined in the y-z plane (the plane lying perpendicular to the latching direction M or to the unlatching direction W). The angle of the inclination is believed best seen in FIG. 3C (for the projection P') and in in FIG. 3I (for the aperture A'). In each of these Figures the inclination is indicated by the character $m_i$. Owing to the inclination of the surface $S_{p2}$ or $S_a$, the one end $L_1$ of the surface $S_{p2}$ lies a distance h from the associated reference surface $R_2$, $R_1$, while at the other end melds into that reference surface.

With reference now to FIG. 4, in general, shown in a particularized implementation of a latching system of the present invention. FIGS. 4A, 4B and FIGS. 4C, 4D illustrate two alternative forms of a connector housing $H_2$ (i.e., a housing having a latching aperture therein), while FIGS. 4E and 4F show a connector housing $H_1$ (i.e., a housing having a latching projection thereon).

Figure 4A:
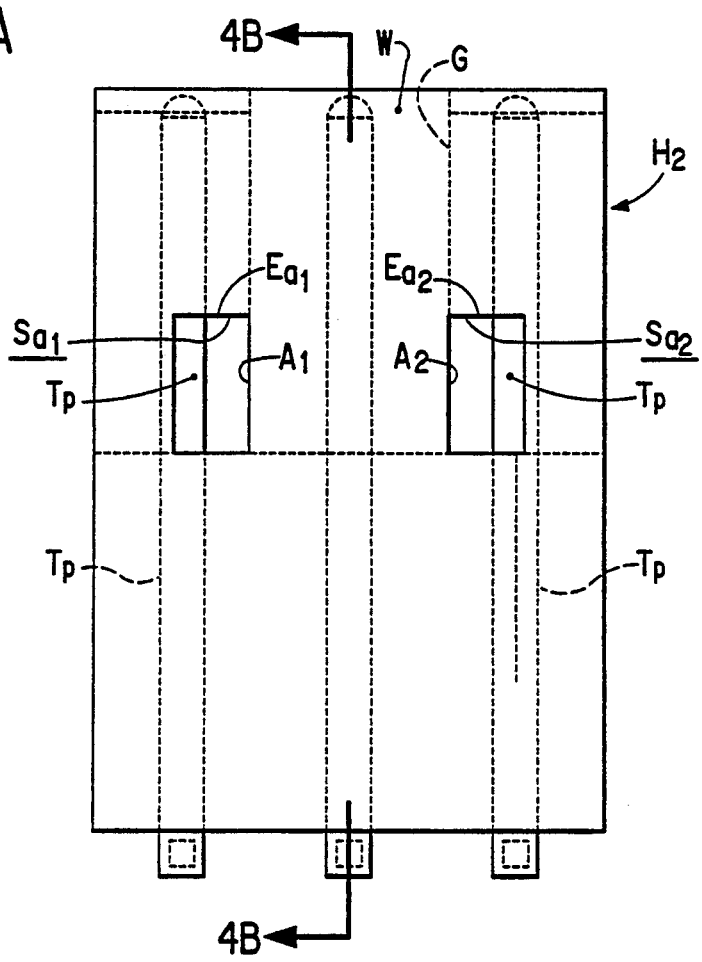
Figure 4B:
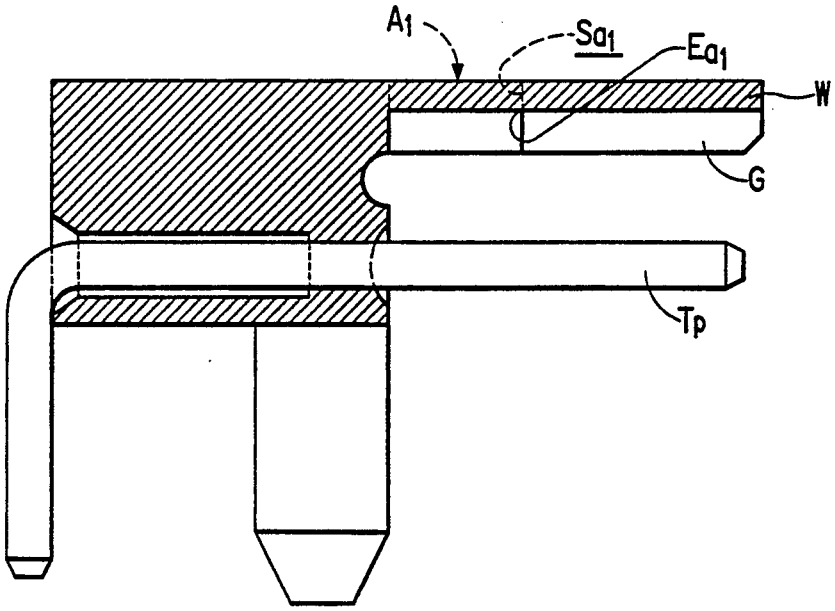

In FIGS. 4A, 4B the connector housing $H_2$ has provided therein a pair of latching apertures as indicated in the Figures by the reference characters $A_1$, $A_2$. The latching apertures $A_1$, $A_2$ are located on opposed sides of a polarizing guideway G. The apertures $A_1$, $A_2$ are enclosed recesses of the prior art type as shown in FIG. 1. The portion of the material of the housing $H_2$ defines a web W of material that is thinner than the material of the surrounding material of the housing $H_2$. The working surface $S_a$ and the working edge $E_a$ of each aperture $A_1$, $A_2$ are indicated in FIGS. 4A, 4B. The electrical connection terminals contained within the housing $H_2$ are in the form of pins $T_p$.

Figure 4C:
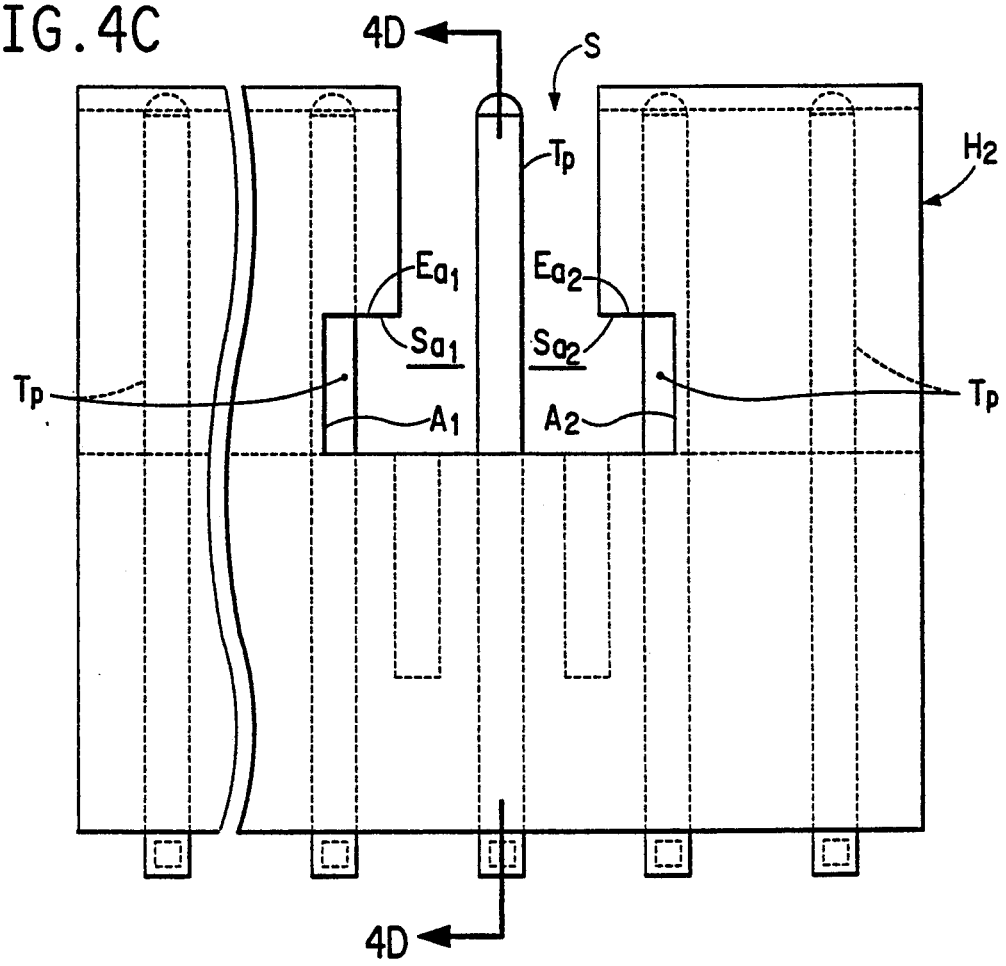
Figure 4D:
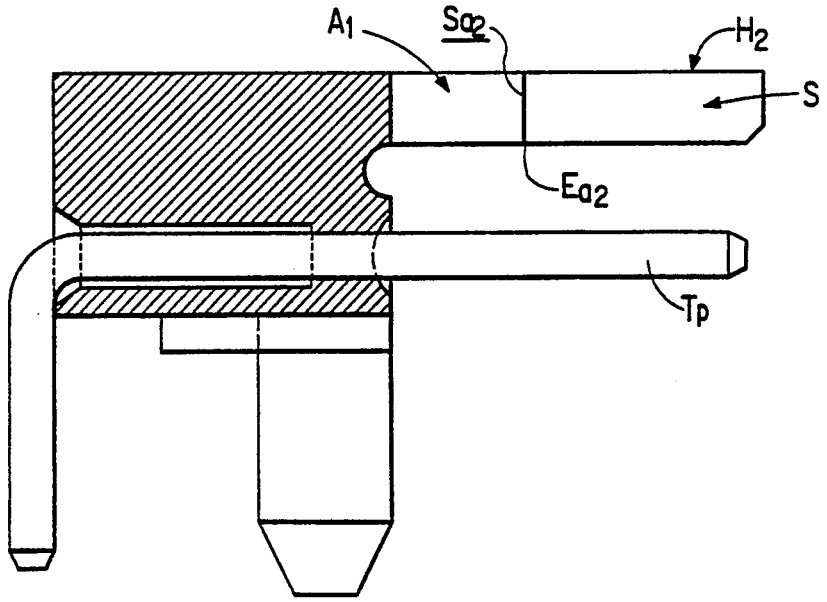

In FIGS. 4C, 4D the material defining the web W is removed, forming a slot S. The latching apertures $A_1$, $A_2$ in the first connector housing $H_2$ communicate with the slot S. The working surface $S_a$ and the working edge $E_a$ of each aperture $A_1$, $A_2$ is also indicated in FIGS. 4C, 4D. The slotted form of housing $H_2$ is preferred in instances in which a housing has more than three laterally adjacent columns of terminal positions. Each column of terminal positions may have any desired number of rows.

Figure 4E:
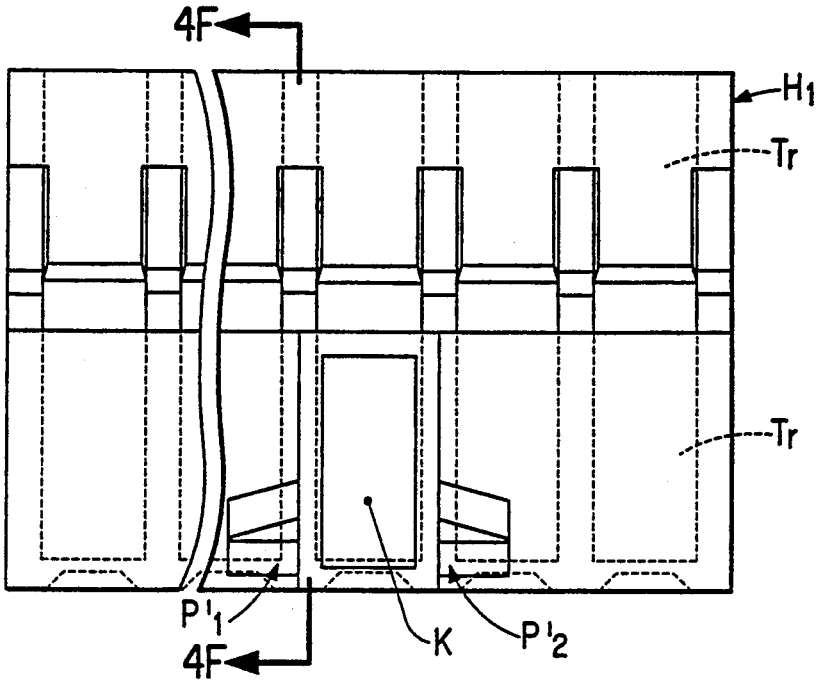
Figure 4F:
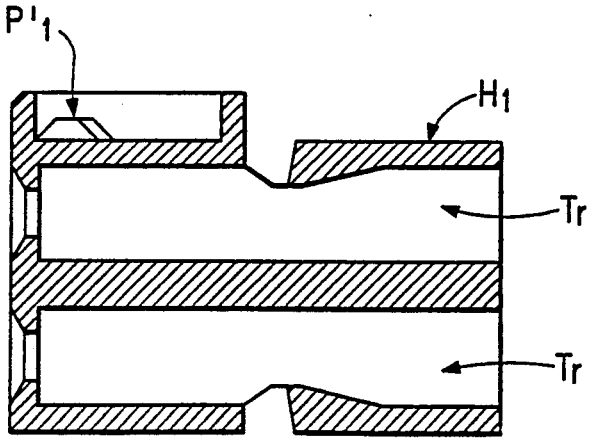

The connector housing $H_1$ having a pair of latching projections $P'_1$, $P'_2$ thereon is shown in FIGS. 4E and 4F. The projections $P'_1$, $P'_2$ are of the type shown in FIG. 2A and are disposed on opposite sides of a polarizing key K also formed on the housing $H_1$. The terminals received in the housing $H_1$ may take the form of the receptacles, and accordingly, appropriately shaped recesses $T_r$ are formed in the housing $H_1$.

Figure 4G:
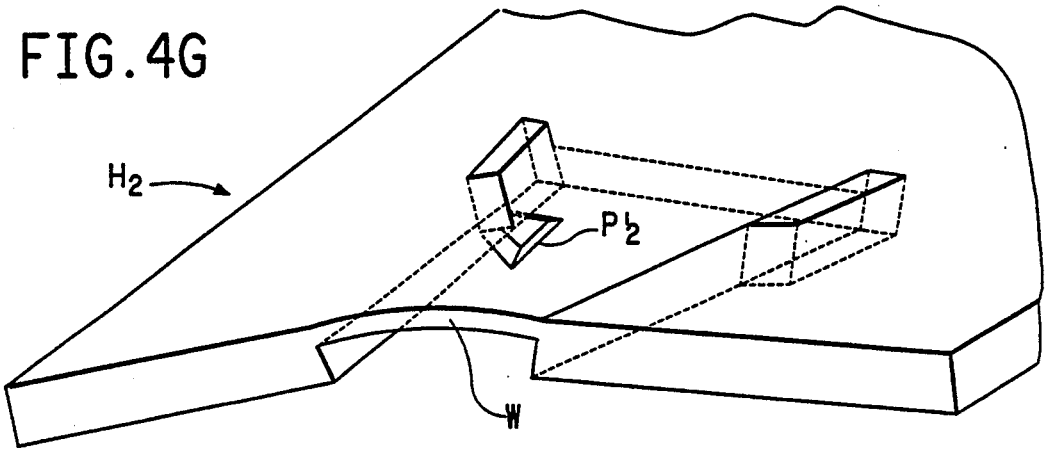
Figure 4H:
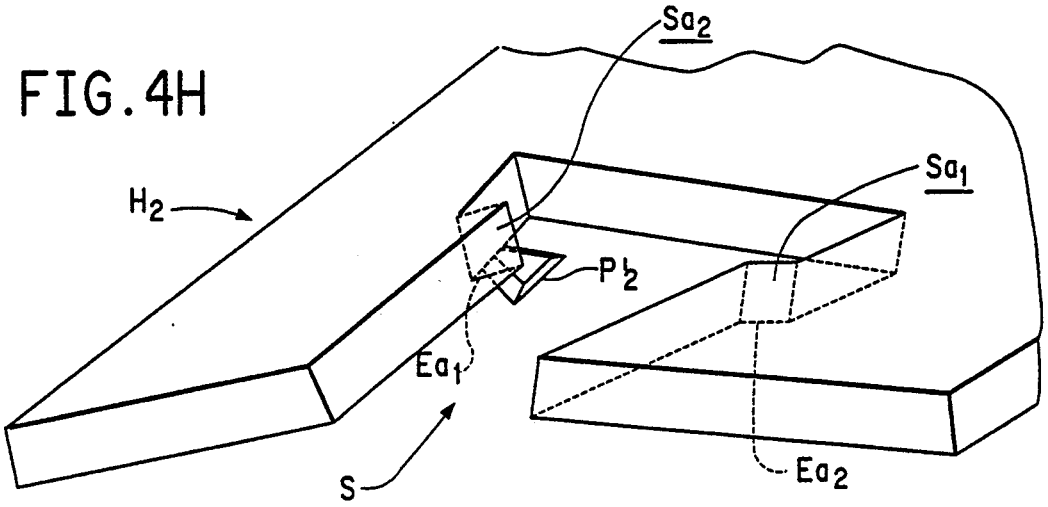

During the unlatching motion, as illustrated in FIGS. 4G, as the housing $H_1$ is withdrawn in the direction W the latching projections $P'_1$, $P'_2$ cause the housing $H_2$ (of the form shown in FIGS. 4A, 4B) to flex, or to buckle, in the vicinity of the relatively thin web portion W. As is illustrated in FIG. 4H, when the housing $H_2$ of the form shown in FIGS. 4C, 4D is used, as the housing $H_1$ is withdrawn, the latching projections $P_1$, $P_2$ again cause flexure, or buckling, of the material of the housing $H_2$ defining the slot S.

Other particularized arrangements using the passive latching system of the present invention may, of course, be implemented. For example, the projections $P'_1$, $P'_2$ may be of the type shown in FIGS. 3A through 3C. Alternatively, projections as shown in FIG. 1 may be used, with apertures as indicated in FIGS. 2B through 2F and FIGS. 3D through 3F being formed in the complementary housing. It should also be understood that the terminal pins $T_p$ may be received in the housing $H_2$ having the apertures while recesses $T_r$ for receptacles may be disposed in the housing $H_1$ having the projections.

Any of the housings $H_1$, $H_2$ shown in this application are preferable fabricated from a plastic material, such as nylon (in the case of the housing $H_1$) or from a liquid crystal polymer (in the case of the housing $H_2$), using an injection molding process.

Figure 5A:
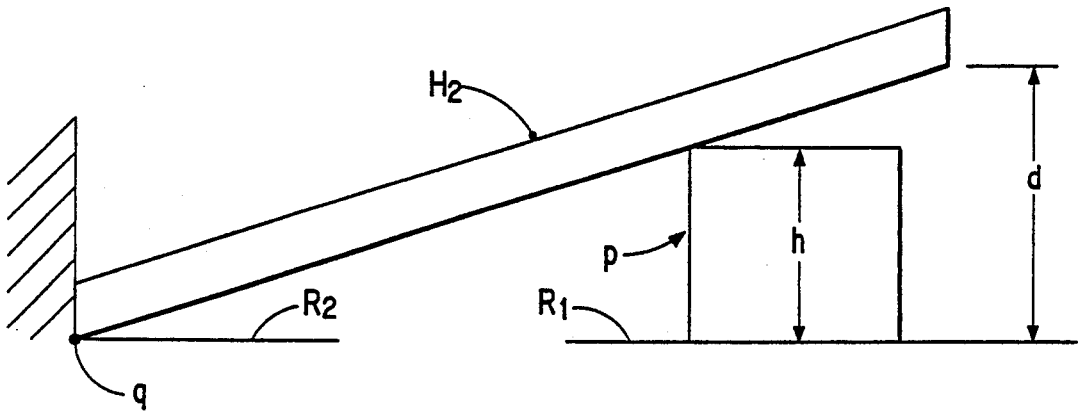
FIGS. 5A and 5B are schematic diagrams respectively illustrating an explanation of the operational advantages obtained using the embodiment of the invention shown in FIGS. 2A through 2F and 3A through 3I.
Figure 5B:
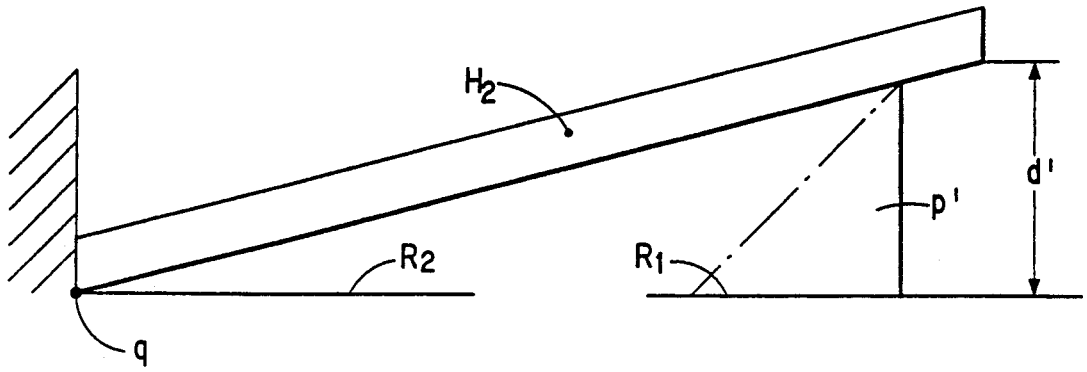

The underlying basis by which the force necessary and/or work required to effect withdrawal of the housings $H_1$, $H_2$ is reduced using the present invention may be more fully understood with reference to FIGS. 5A and 5B.

If the portion of the housing $H_2$ (the housing having the aperture) is viewed as a beam that must be deflected as the housing $H_1$ (the housing having the projection P) is withdrawn therefrom, and if the projection P extends a height h above the pivot point q of the beam, it is apparent from inspection of FIG. 5A that an amount of work sufficient to deflect the housing $H_2$ the distance d is required to effect removal of the housings $H_1$, $H_2$. The force sufficient to effect this work must be applied over the distance D (FIG. 1).

Using the embodiment of the invention shown in FIG. 2A or FIGS. 2B through 2G, it will be appreciated from FIG. 5A that although the work required is the same, the distance over which a removal force is applied is increased (to the distance D', FIG. 2A).

Moreover, when the embodiment of the invention shown in FIGS. 3A through 3C or FIGS. 3D through 3I is used, it is required that the beam be deflected only for the distance d', a distance less than the distance d (FIG. 5A). Accordingly, not only is the magnitude of the required removal force reduced, but the amount of work required is also reduced. In addition, the beam length (the distance from the pivot point to the end of the beam) is greater, resulting in a longer moment arm. From the foregoing it should be appreciated that any amount of inclination $m_i$ (FIGS. 3C, 3I) of the tapered working surface in the y-z plane in accordance with the modified embodiment of the invention will result in a decrease in the amount of work required.

Since there is a reduction in the force needed to unlatch the housings from each other, the energy requirements are also less, resulting in greater toughness (i.e., higher reliability over time).

Those skilled in the art, having the benefit of the teachings of the present invention as hereinabove set forth may effect numerous modifications thereto. Such modifications as are discussed herein and which appear to those skilled in the art are to be construed as lying within the scope of the present invention, as defined by the appended claims.

What is claimed is:

1. A passive latch for interconnecting a first and a second connector housing when the first and second housings are relatively moved in a latching direction with respect to each other, each of the housings having a reference surface thereon, one of the housings having at least one working surface depressed from the reference surface thereof to form part of a latching aperture while the other of the housing has at least one working surface raised from the reference surface thereof to form part of a latching projection, the working surface on one of the housings being (a) sloped with respect to its reference surface, the improvement comprising:

the sloped working surface also is (b) tapered in a direction that is generally parallel with respect to the latching direction.

2. The passive latch of claim 1 wherein the depressed surface is the working surface that is tapered.

3. The passive latch of claim 1 wherein the raised surface is the working surface that is tapered.

4. The passive latch of claim 3 wherein the tapered working surface is also (c) inclined in a direction that is substantially perpendicular to the latching direction.

5. The passive latch of claim 2 wherein the tapered working surface is also (c) inclined in a direction that is substantially perpendicular to the latching direction.

6. The passive latch of claim 1 wherein the tapered working surface is also (c) inclined in a direction that is substantially perpendicular to the latching direction.

* * * * *